US006618576B2

(12) United States Patent
Kanari et al.

(10) Patent No.: US 6,618,576 B2
(45) Date of Patent: Sep. 9, 2003

(54) IMAGE FORMING APPARATUS

(75) Inventors: Kenji Kanari, Shizuoka (JP); Takayasu Yuminamochi, Shizuoka (JP); Yasuhiro Nakata, Tochigi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/096,752

(22) Filed: Mar. 14, 2002

(65) Prior Publication Data

US 2002/0146261 A1 Oct. 10, 2002

(30) Foreign Application Priority Data

Mar. 16, 2001 (JP) ..... 2001/076811

(51) Int. Cl.[7] ..... G03G 15/16
(52) U.S. Cl. ..... 399/388; 399/316
(58) Field of Search ..... 399/121, 296, 399/316, 388, 390

(56) References Cited

U.S. PATENT DOCUMENTS 5,926,683 A 7/1999 Yuminamochi et al. ..... 399/398
6,125,244 A * 9/2000 Kamiya ..... 399/44
6,493,534 B2 * 12/2002 Sawanaka et al. ..... 399/316

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an image bearing member, a transferring device for transferring an image formed on the image bearing member to a transfer material, a transporting device for transporting the transfer material, a regulating member for regulating the transport direction of the transfer material. The charge eliminating member includes a charge eliminating portion and a supporting portion for supporting the charge eliminating portion. The regulating member has a top portion most, which protrudes in a direction from the supporting portion toward the charge eliminating portion of the charge eliminating member. When the transfer material is not being transported, a length from a boundary portion of the regulating member between the charge eliminating portion and the supporting portion to a distal end of the charge eliminating portion is defined as "a" (mm), a length from the boundary portion to the transport plane of the transfer material in a direction along the charge eliminating portion is defined as "b" (mm), and a length from the boundary portion to the top portion of the regulating member is defined as "c" (mm), wherein the conditions that $a-b \geqq 0.5$ (mm) an $a-b \leqq b$ and $a<c$ are satisfied.

5 Claims, 14 Drawing Sheets

FIG. 12

| NUMBER OF SUPPLIED SHEETS [k SHEETS] | EMBODIMENT 3 | REFERENCE EXAMPLE | |
|---|---|---|---|
| | HALFTONE STREAK | HALFTONE STREAK | NUMBER OF BROKEN HAIRS OF BRUSH |
| 1 | △ | ○ | 0 |
| 50 | △ | △ | 15 |
| 100 | △ | × | 38 |
| 150 | △ | × | 49 |
| 200 | △ | × | 53 |

○: GOOD △: ALLOWABLE ×: BAD

FIG. 15

| PAPER | OFFICE PLANNER | SANYI COPY PAPER | |
|---|---|---|---|
| | LEFT PAPER | JUST OPENED PAPER | LEFT PAPER |
| REFERENCE EXAMPLE | ○ | △ | × |
| EMBODIMENT 4 | ○ | ○ | △ |

○: GOOD △: ALLOWABLE ×: BAD

IMAGE FORMING APPARATUS

BACKGROUND OF THE INVENTION

1. Field of the Invention

The invention relates to an image forming apparatus such as a copying machine, a printer or a facsimile apparatus for effecting image formation by the electrophotographic process or the electrostatic recording process.

2. Description of Related Art

In an image forming apparatus such as a copying machine for effecting image formation by the electrophotographic process, the productivity (the number of prints per unit time) of the apparatus is a very important measure, and in recent years, higher productivity has been required. On the other hand, a higher quality of the output image of the image forming apparatus also is an important measure, and a high quality of image has also been required.

So, in recent years, in order to achieve an improvement in the productivity of the image forming apparatus, design has come to be made so as to transport a transfer material such as paper at a higher speed, but to obtain an output image of high quality, it is particularly important to transport the transfer material such as paper stably to a transferring portion between a photosensitive drum and transferring means (such as a transferring roller).

Particularly when the transfer material is thick paper (cardboard) or the like, if the leading edge of the transfer material (cardboard) is not struck against a predetermined position on the photosensitive drum so that the transfer material fails to be transported to the transferring portion, the transporting speed becomes unstable, and this has sometimes led to a case where the output image is disturbed and the quality of image is reduced particularly when the output image is a halftone image or the like.

So, there is conceived an image forming apparatus in which, as shown in FIG. 16 of the accompanying drawings, a charge eliminating brush member 103, a transport regulating member 104 and an upper transfer guide 105 are installed downstream of a pair of registration rollers 100 provided upstream of a transferring portion (not shown) in the transport direction of a transfer material so that the transfer material can be transported to the transferring portion with the leading edge thereof stably struck against the predetermined position on a photosensitive drum. FIG. 16 shows the background art of the present invention.

The pair of registration rollers 100 are comprised of an upper registration roller 101 and a lower registration roller 102 rotatably brought into pressure contact with each other, and a registration nip portion N is formed between the upper registration roller 101 and the lower registration roller 102.

The pair of registration rollers 100 once stops a transfer material P transported from a feed cassette (not shown) at the registration nip portion N, and are rotatively driven in timed relationship with the formation of a toner image on the photosensitive drum (not shown) to thereby transport the transfer material P to the downstream transferring portion.

The charge eliminating brush member 103 is comprised of a brush portion 103*b* supported by a brush supporting portion 103*a*. The transport regulating member 104 has a transport guide portion 104*a* inclined in the transport direction of the transfer material P. The distal end of the top 104*b* of the transport guide portion 104*a* with which the transporting transfer material P contacts is obliquely downwardly bent with respect to the transport direction of the transfer material P. The top 104*b* of the transport guide portion 104*a* is located a little above with respect to the horizontal direction in the registration nip portion N.

Downstream of the transport regulating member 104 in the transport direction of the transfer material, there is provided an upper transfer guide 105 for causing the transfer material P being transported to contact with the predetermined position on the photosensitive drum and guiding it to the transferring portion.

The transfer material P nipped and transported by the registration nip portion N between the pair of registration rollers 100 as described above contacts with the brush portion 103*b* of the charge eliminating brush member 103 and has its charges eliminated thereby, and the leading edge of the charge-eliminated transfer material P strikes against the inclined surface of the transport guide portion 104*a* of the transport regulating member 104 and is guided to the upper transfer guide 105 while contacting with the top 104*b*. The upper transfer guide 105 guides the leading edge of the transfer material P so as to strike against the predetermined position on the photosensitive drum. The transfer material P, which has struck against the predetermined position on the photosensitive drum, is transported to the transferring portion between the photosensitive drum and transferring means, and the toner image on the photosensitive drum is transferred to the transfer material P.

By the transport regulating member 104 being provided downstream of the pair of registration rollers 100 as described above, the leading edge of the transfer material P stably contacts with the predetermined position on the photosensitive drum and is directed to the transferring portion. Consequently, the transport of the transfer material P to the transferring portion is stabilized, whereby even if as described above, a halftone image is transferred in the transferring portion by the use of a transfer material such as cardboard disadvantageous to transport, a good output image can be obtained.

Now, in the above-described image forming apparatus, the charge eliminating brush member 103 having the brush portion 103*b* for eliminating the charges of the transfer material P is provided upstream of the transport regulating member 104, but there has been a case where as the number of prints increases, the brush portion 103*b* contacting with the transfer material P comes off the brush supporting portion 103*a* or the brush portion 103*b* breaks from the surface of the brush supporting portion 103*a*.

This is because during the transport of the transfer material P, the transfer material P contacts with the brush portion 103*b*, whereby the brush portion 103*b* flexes in the transport direction of the transfer material P, whereby a load is repetitively applied to the root of the brush portion 103*b* which is exposed from the surface of the brush supporting portion 103*a*. Further, during the transport of the transfer material P, the transfer material P contacts with the brush portion 103*b*, whereby the brush portion 103*b* is sandwiched between the transfer material P and the transport guide portion 104*a*, whereby the load applied to the brush portion 103*b* becomes great, and the brush portion 103*b* becomes liable to come off or break.

As described above, the brush portion 103*b* has the role of eliminating the charges of the transfer material P upstream of the transferring portion, but will become incapable of appropriately eliminating the charges of the transfer material P before transfer if the brush portion 103*b* comes off or breaks as described above. If the transfer material P is charged, uneven transfer may occur during the transfer of the toner image in the transferring portion. This uneven transfer appears as a density difference particularly in a halftone image, and is a conspicuous phenomenon.

Also, the brush portion 103*b* has electrical conductivity and therefore, if the brush portion 103*b* comes off or breaks, it will scatter in the image forming apparatus, and if the scattered brush portion 103*b* contacts with an electrical contact portion in the image forming apparatus, electrical leak will be caused and the image forming apparatus may come not to operate normally.

SUMMARY OF THE INVENTION

It is an object of the present invention to provide an image forming apparatus in which the coming-off or break of a charge eliminating member by sheet supply endurance can be prevented and the charges of a recording material can be stably eliminated by the charge eliminating member for a long period.

It is another object of the present invention to provide an image forming apparatus having an image bearing member, transferring means for transferring an image formed on the image bearing member to a transfer material, transporting means for transporting the transfer material to between the image bearing member and the transferring means, a regulating member for regulating the transport direction of the transfer material downstream of the transporting means in the transport direction of the transfer material, and a charge eliminating member for eliminating the charges of the transfer material downstream of the transporting means and upstream of the regulating member in the transport direction of the transfer material, the charge eliminating member having a charge eliminating portion and a supporting portion for supporting the charge eliminating portion, the regulating member having a top portion most protruded in a direction from the supporting portion toward the charge eliminating portion of the charge eliminating member, wherein when in a state in which the transfer material is not being transported, the length from the boundary portion between the charge eliminating portion and the supporting portion to the distal end of the charge eliminating portion is defined as "a" (mm), and the length from the boundary portion to the transport plane of the transfer material in a direction along the charge eliminating portion is defined as "b" (mm), and the length from the boundary portion to the top portion of the regulating member is defined as "c" (mm), the conditions that $a-b \geqq 0.5$ (mm), $a-b \leqq b$ and $a<c$ are satisfied.

Further objects of the present invention will become apparent from the following description.

BRIEF DESCRIPTION OF THE DRAWINGS

FIG. 12 is a view showing the result of an experiment, which examined the occurrence of streaks on a halftone image when the sheet supply endurance test of the halftone images was done.

FIG. 15 is a view showing the result of an experiment, which examined the occurrence of streaks on halftone images when the sheet supply endurance test of the halftone images was done.

DESCRIPTION OF THE PREFERRED EMBODIMENTS

Figure 1:
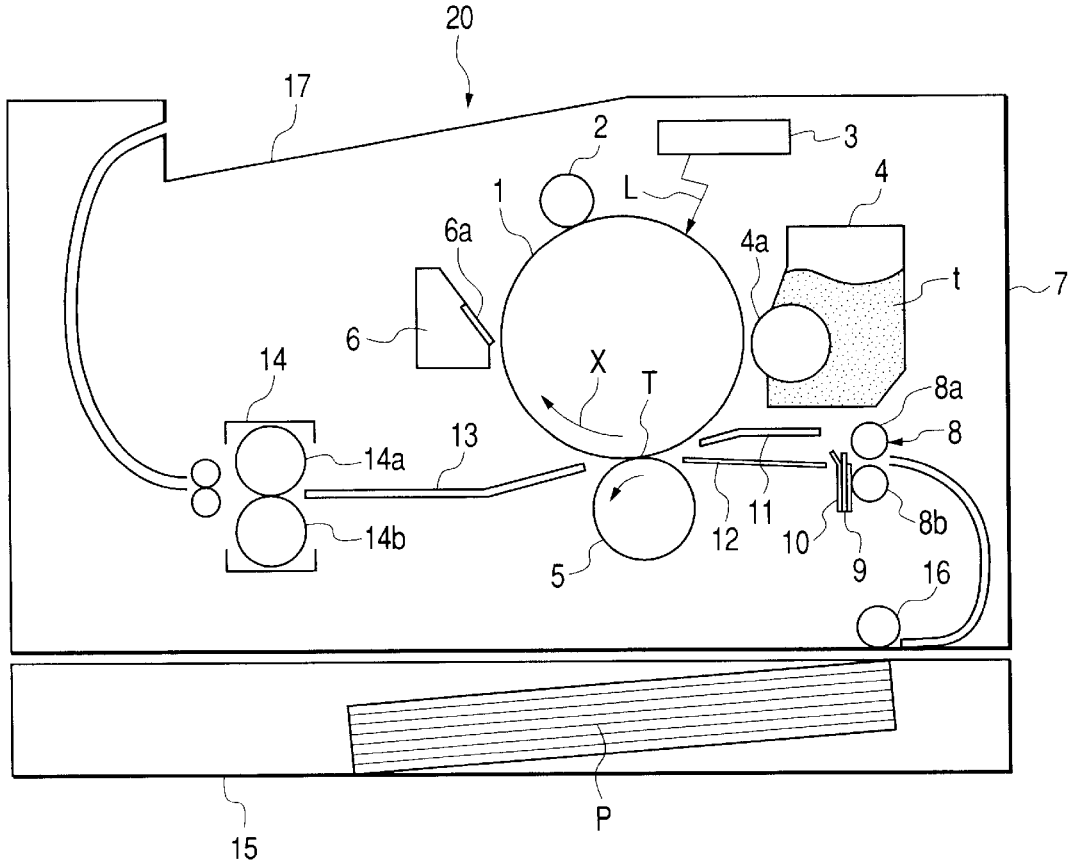
FIG. 1 is a view showing an image forming apparatus, which is an embodiment of the present invention.

The present invention will hereinafter be described with respect to the embodiments thereof shown in the drawings.

FIG. 1 is a view schematically showing the construction of an image forming apparatus, which is an embodiment of the present invention (in the present embodiment, an image forming apparatus such as a laser printer of the electrophotographic type).

The image forming apparatus 20 is provided with a photosensitive drum 1 as an image bearing member. Around the photosensitive drum 1, a charging roller 2, an exposing device 3, a developing device 4, a transferring roller 5 which is transferring means, and a cleaning device 6 are disposed in the named order along the direction of rotation of the photosensitive drum 1. In the present embodiment, the photosensitive drum 1, the charging roller 2, the developing device 4 and the cleaning device 6 are integrally made into a cartridge to thereby form a process cartridge (not shown), which is detachably mounted on the main body 7 of the image forming apparatus.

Also, upstream of the transfer nip portion T between the photosensitive drum 1 and the transferring roller 5 in the transport direction of a transfer material, there are installed a pair of registration rollers 8 which are transporting means, a charge eliminating brush member 9 which is a charge eliminating member, a transport regulating member 10, an upper transfer guide 11 and a lower transfer guide 12, and downstream of the transfer nip portion T in the transport direction of the transfer material, there are installed a transport guide 13 and a fixing device 14.

In the present embodiment, the photosensitive drum 1 is a negative chargeable organic photoconductive drum having an OPC photosensitive layer on a drum base made of aluminum, and is rotatively driven at a predetermined peripheral speed (process speed) in the direction indicated by the arrow X (clockwise direction) by driving means (not shown), and is subjected to uniform charging of the negative polarity by the charging roller 2 in the rotating process thereof.

The charging roller 2 as contact charging means contacts with the surface of the photosensitive drum 1 with a predetermined pressure force and is driven to rotate thereby, and charges the photosensitive drum 1 to a predetermined polarity and predetermined potential by a charging bias applied from a charging bias voltage source (not shown).

The exposing device 3 outputs from a laser output portion (not shown) a laser beam (exposure beam) modulated correspondingly to the time-series electrical digital image signal of image information inputted from a personal computer (not shown) or the like, and scan-exposes L the charged surface of the photosensitive drum 1 to thereby form thereon an electrostatic latent image corresponding to the image information.

The developing device 4 is provided with a rotatable developing sleeve 4*a* substantially contacting with the surface of the photosensitive drum 1, and causes a toner "t" to adhere to the electrostatic latent image on the photosensitive drum 1 in a developing portion to thereby visualize it as a toner image.

The transferring roller 5 as contact transferring means contacts with the surface of the photosensitive drum 1 with a predetermined pressure force to thereby form the transfer nip portion T, and transfers the toner image on the surface of the photosensitive drum 1 to a transfer material P which is a recording material such as paper in the transfer nip portion T between the photosensitive drum 1 and the transferring roller 5 by a transfer bias applied from a transfer bias voltage source (not shown).

The cleaning device 6 has a cleaning blade 6*a* and removes and collects any untransferred toner residual on the surface of the photosensitive drum 1 after the transfer by the cleaning blade 6*a*.

Figure 2:
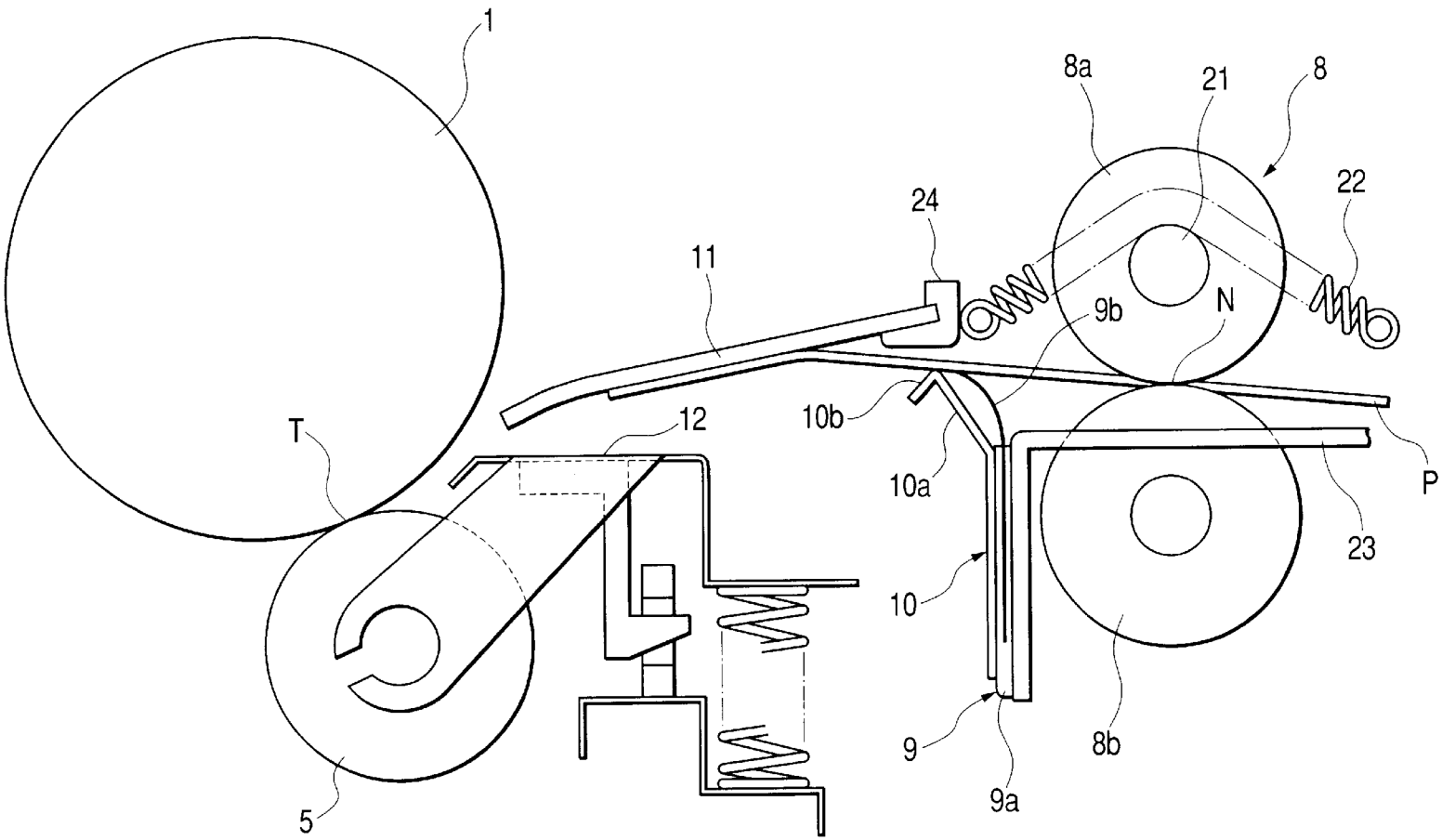
FIG. 2 is a view showing the surroundings of the transport regulating member and charge eliminating brush member of an image forming apparatus according to Embodiment 1.

The pair of registration rollers 8, as shown in FIGS. 1 and 2, are comprised of an upper registration roller 8*a* and a lower registration roller 8*b* rotatably brought into pressure contact with each other, by a pressure spring 22 engaged with the rotary bearing 21 of the upper registration roller 8*a*, where by a registration nip portion N is formed. The pair of registration rollers 8 once stops the transfer material P transported from a feed cassette 15 at the registration nip portion N, and is rotatively driven in timed relationship with the formation of the toner image on the photosensitive drum 1, and transports the transfer material P to the downstream transfer nip portion T.

Downstream of the pair of registration rollers 8 in the transport direction of the transfer material, there are provided a charge eliminating brush member 9 for eliminating the charges of the transfer material P and a transport regulating member 10 for regulating the transport of the transfer material P (the details of the charge eliminating brush member 9 and the transport regulating member 10 which are the features of the present invention will be described later).

The fixing device 14 has a heat roller 14*a* provided with a halogen heater (not shown) therein and a pressure roller 14*b*, and heats and pressurizes the toner image transferred to the surface of the transfer material P and heat-fixes it while nipping and transporting the transfer material P by the fixing nip portion between the heat roller 14*a* and the pressure roller 14*b*.

Description will now be made of the image forming operation of the above-described image forming apparatus 20.

During the image formation, the photosensitive drum 1 is rotatively driven at a predetermined peripheral speed in the direction indicated by the arrow X (clockwise direction) by driving means (not shown), and is uniformly charged to a predetermined potential of the negative polarity by the charging roller 2 to which a charging bias is applied from a charging bias voltage source (not shown). Scanning exposure L by a laser beam is then given from the exposing device 3 onto the charged photosensitive drum 1, whereby the potential of that portion of the photosensitive drum 1 which has been scan-exposed L is lowered, and an electrostatic latent image conforming to the image information inputted from a personal computer (not shown) or the like is formed.

Then, in the developing portion, the toner "t" is caused to adhere to the electrostatic latent image formed on the photosensitive drum 1, by the developing sleeve 4*a* of the developing device 4 to which has been applied a developing bias of the same polarity as the charged polarity (negative polarity) of the photosensitive drum 1, and the electrostatic latent image is visualized as a toner image by reversal developing.

On the other hand, the transfer material P in the cassette 15 is fed by a pickup roller 16 and is transported to the pair of registration rollers 8 in synchronism with the formation of the toner image on the photosensitive drum 1. Then, in timed relationship with the arrival of the toner image on the photosensitive drum 1 at the transfer nip portion T between the photosensitive drum 1 and the transfer roller 5, the transfer material P is transported to the transfer nip portion T by the pair of registration rollers 8.

The toner image on the photosensitive drum 1 is then transferred to the transfer material P transported to the transfer nip portion T, by an electrostatic force generated between the photosensitive drum 1 and the transferring roller 5 by the transferring roller 5 to which the transfer bias of the opposite polarity (positive polarity) to the toner "t". The transfer material P to which the toner image has been transferred is then transported to the fixing device 14 through the transport guide 13, and in the fixing nip portion between the heat roller 14*a* and the pressure roller 14*b*, the toner image is heat-fixed on the transfer material P by heating and pressing. The transfer material P on which the toner image has been fixed is delivered onto a delivery tray 17, thus completing a series of image forming operations.

Also, any untransferred toner residual on the photosensitive drum 1 after the transfer is removed and collected by the cleaning blade 6*a* of the cleaning device 6.

The details of the charge eliminating brush member 9 and the transport regulating member 10 in Embodiment 1 of the present invention will now be described.

As shown in FIGS. 1 and 2, the charge eliminating brush member 9 for effecting the charge elimination of the transfer material P is installed downstream of the pair of registration rollers 8 in the transport direction of the transfer material, and the transport regulating member 10 for regulating the transport direction of the transfer material P is installed downstream of the charge removing brush member 9 in the transport direction of the transfer material and upstream of the upper transfer guide 11 and the lower transfer guide 12 in the transport direction of the transfer material.

The charge eliminating brush member 9 has an electrically conductive, flexible brush portion 9*b* which is a charge eliminating portion contacting with the transfer material P being transported, and the brush portion 9*b* is implanted on a brush supporting portion 9*a* along a direction orthogonal to the transport direction of the transfer material. Also, the charge eliminating brush member 9 is secured to a registration guide member 23. The transport regulating member 10 is secured to the brush supporting portion 9*a* of the charge eliminating brush member 9 in such a manner as to be located downstream of the charge eliminating brush member 9 in the transport direction of the transfer material.

The upper portion of the transport regulating member 10 has a transport guide portion 10*a* inclined toward the transport direction of the transfer material P. The distal end side of the top portion (i.e., that portion of the regulating member which is most protruded in a direction from the supporting portion to the charge eliminating portion of the charge eliminating member) 10*b* of the transport guide portion 10*a* which is contacted by the transfer material P being transported is bent obliquely downwardly with respect to the transport direction of the transfer material P. The top portion 10*b* of the transport guide portion 10*a* is located a little above with respect to the horizontal direction in the registration nip portion N.

Also, downstream of the transport regulating member 10 in the transport direction of the transfer material, there are provided an upper transfer guide 11 and a lower transfer guide 12 for bringing the transfer material P being transported into contact with a predetermined position on the photosensitive drum 1 to thereby guide the transfer material P to the transfer nip portion T. A transfer material trailing edge regulating member 24 is mounted at a location at the rear end of the upper transfer guide 11, which is opposed to the transport guide portion 10*a*. The transfer material trailing edge regulating member 24 suppresses the trailing edge of the transfer material P from jumping up to thereby make the transport speed of the transfer material P unstable when the trailing edge of the transfer material P being transported has passed through the registration nip portion N.

Consequently, the leading edge of the transfer material P having passed while contacting with the top portion 10*b* of the transport guide portion 10*a* abuts against the upper transfer guide 11, and the transfer material P transported along the upper transfer guide 11 is loose in its angle of entry at which it abuts against the photosensitive drum 1, and can be guided to the transfer nip portion T with the shock when the transfer material P contacts with the photosensitive drum 1 being mitigated.

As described above, the transport guide portion 10*a* of the transport regulating member 10 is provided downstream of the registration nip portion N in the transport direction of the transfer material, whereby the stable transport of the transfer material P to the transfer nip portion T becomes possible.

Figure 3:
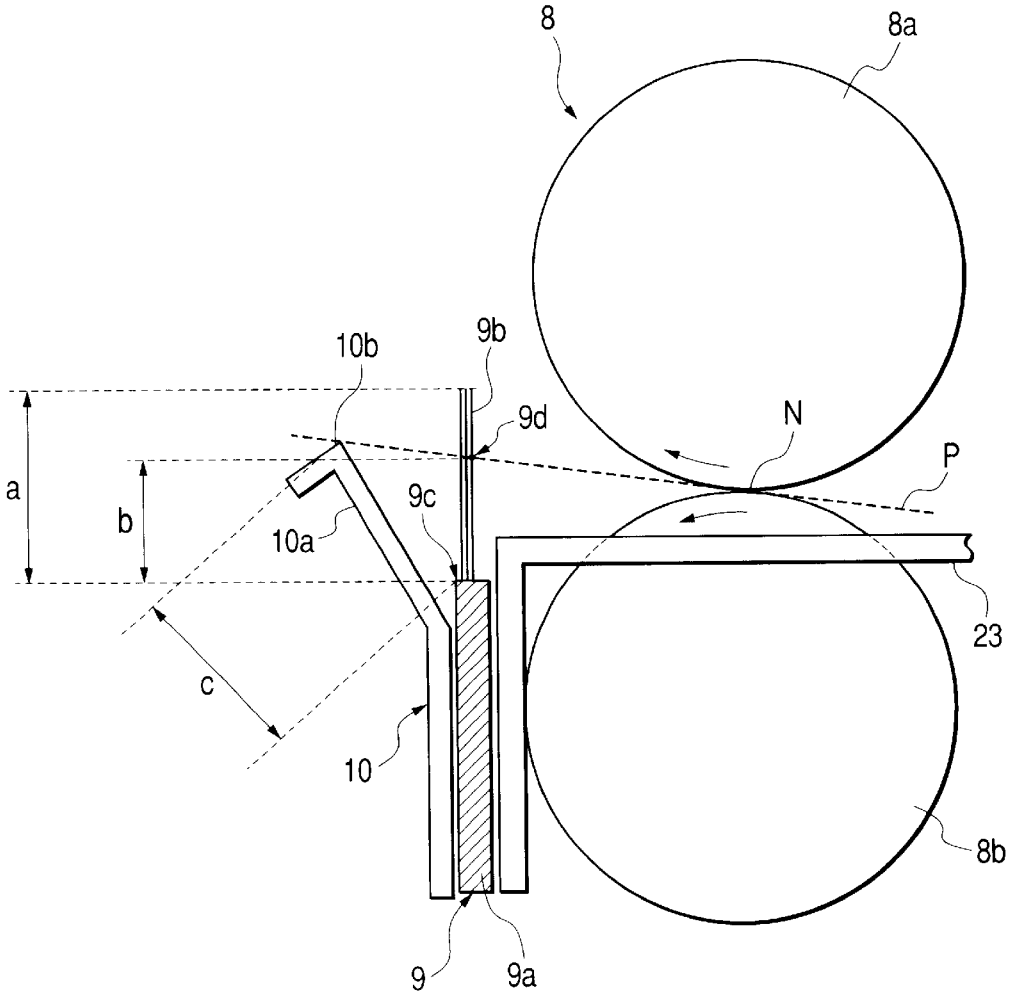
FIG. 3 is a view showing the transport regulating member and charge eliminating brush member of the image forming apparatus according to Embodiment 1.

When as shown in FIG. 3, the vertical length from the boundary portion 9*c* between the brush supporting portion 9*a* and brush portion 9*b* of the charge eliminating brush member 9 when the transfer material P is not in contact is defined as "a", and the vertical length from the boundary portion 9*c* of the charge eliminating brush member 9 to the transport path 9*d* of the transfer material P is defined as "b", and the length from the surface 9*c* (boundary portion) of the brush supporting portion 9*a* supporting the brush portion 9*b* to the top portion 10*b* of the transport guide portion 10*a* which is contacted by the transfer material P is defined as "c", the inventor effected the evaluation of the above-mentioned lengths "a", "b", and "c" and the charge eliminating property of the brush portion 9*b* for the transfer material P and the manner of breaking of the brush portion 9*b* from the brush supporting portion 9*a*.

In FIG. 3, the length "a" from the boundary portion 9*c* to the distal end of the brush portion 9*b* of the charge eliminating brush member 9 minus the length "b" from the boundary portion 9*c* of the charge eliminating brush member 9 to the transport path of the transfer material P, i.e., (a−b), is the length of the brush portion 9*b* protruding from the height when the transfer material P passes the brush portion 9*b* (hereinafter the length (a−b) will be referred to as the brush contact amount).

Figure 4:
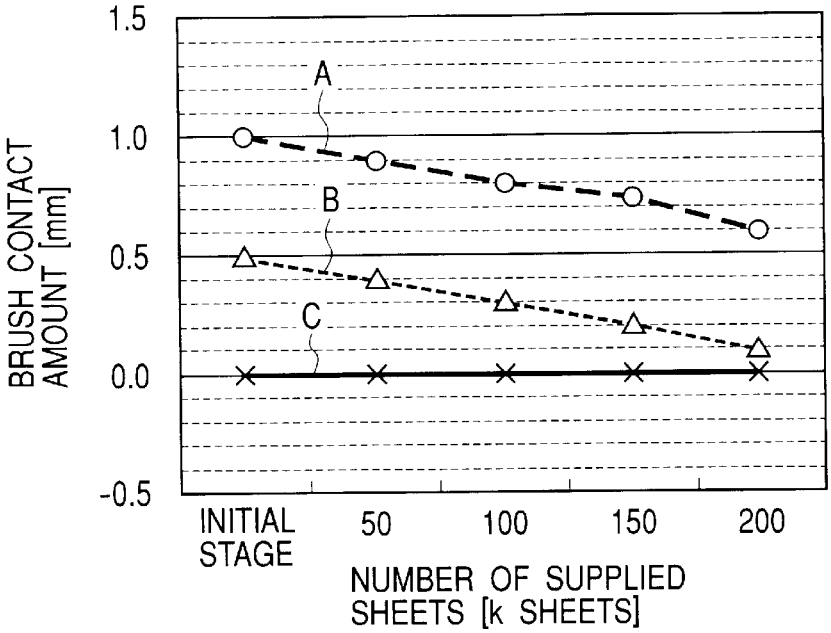
FIG. 4 is a view showing the result of an experiment, which evaluated the occurrence of streaks on a halftone image by a charge in the brush contact amount when the sheet supply endurance test of the halftone image was done.

FIG. 4 shows the result of an experiment which evaluated the occurrence of streaks on halftone images by a change in the above-mentioned brush contact amount when the halftone images were outputted (sheet supply endurance test), and the charge eliminating property of the brush portion 9*b* can be evaluated by the streaks occurring on the halftone images.

When as shown in FIG. 4, the brush contact amount is 1.0 mm at the initial stage (A in FIG. 4), there is no density difference between the halftone images even in the sheet supply endurance test and the halftone images are at a good level and the charge eliminating property also is good. Also, when the brush contact amount is 0.5 mm at the initial stage (B in FIG. 4), there is some density difference along the longitudinal direction of the sheet supply of the halftone images by the sheet supply endurance test and it was a level at which the density difference slightly looked like a streak but could be allowed and the charge eliminating property could also be allowed. Also, when the brush contact amount was 0.0 mm at the initial stage (C in FIG. 4), it was a bad level at which the streak clearly looked like a halftone image by the sheet supply endurance test and the charge eliminating property also was bad.

The evaluation of the occurrence of the streak on the halftone image and the charge eliminating property by the change in the brush contact amount shown in FIG. 4 was carried out under the following conditions.

In this evaluation, use was made of the image forming apparatus shown in FIG. 1 wherein the transport speed of the transfer material P (paper) is 250 mm/sec. and A4 size paper oriented in its lateral direction is supplied at a speed of 50 ppm. Also, the charge eliminating property of the brush portion 9*b* was evaluated with a halftone image printed under a low-temperature and low-humidity environment of temperature 15° C. and humidity 10% RH. Also, the sheet supply endurance test was carried out with a character image of a coverage rate 4% printed at A4 lateral size.

The paper as the transfer material P used in this evaluation was Office Planner (Canon Sales Co., Inc. brand) A4 size basis weight 64 g. Also, in order to make the paper easily charged, use was made of paper left under a low-temperature and low-humidity environment of temperature 15° C. and humidity 10% RH for 24 hours and having a moisture content of 4.3(%).

The moisture content before the paper was left under the above-mentioned environment was 5.8(%). The moisture content of the paper was measured by the use of MOISTREX MX5000E produced by Infrared Engineering Co., Inc.

As the halftone image in this evaluation, use was made of a pattern of 600 dpi in which a lateral line corresponding to two dots was written in the main scanning direction, and thereafter a space corresponding to three dots was provided and this was repeated. Also, as the brush portion 9*b* of the charge eliminating brush member 9, use was made of a bundle of six amorphous fibers each of 20 $\mu$m disposed at a lengthwise width of 300 mm and a pitch of 2.4 mm.

As is apparent from the result of the evaluation shown in FIG. 4, when the brush contact amount is small, streaks become liable to occur on the halftone images and the charge eliminating property is reduced. It is because the brush portion 9*b* rubs against the paper and is worn off that the brush contact amount becomes small in the sheet supply endurance test. It has been found from this evaluation that to suppress the streaks occurring on the halftone images within the range of an allowable level, it is necessary for the brush contact amount (a−b) of the brush portion 9*b* to be 0.5 (mm) or greater at the initial stage. That is, during the condition of $a-b \geqq 0.5$ (mm), the charge eliminating property of the brush portion 9*b* can be maintained at a good level.

Description will now be made of the relation between the brush contact amount (a−b) of the brush portion 9*b* and the length "b" from the boundary portion 9*c* of the charge eliminating brush member 9 to the transfer material transporting path 9*d*, and the break of the brush portion 9*b*.

Figure 5:
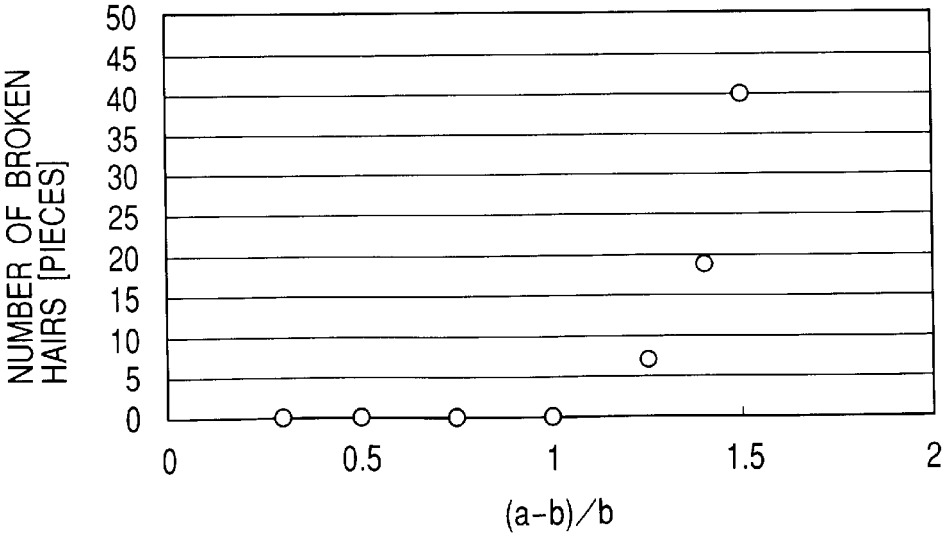
FIG. 5 is a view showing the result of an experiment, which examined the number of broken hairs of a brush portion when the sheet supply endurance test was done with the length from a supporting portion to a transfer material transporting path made variable.

FIG. 5 shows the result of an experiment which examined the number of broken hairs of the brush portion 9*b* from the brush supporting portion 9*a* when the brush contact amount (a−b) was fixed at 1.0 (mm) and the length "b" from the boundary portion 9*c* to the transfer material transporting path 9*d* was made variable and a sheet supply endurance test was done.

Again in this experiment, use was made of the image forming apparatus shown in FIG. 1 wherein the transport speed of the transfer material (paper) P is 250 mm/sec. and A4 size paper oriented in a lateral direction is supplied at a speed of 50 ppm, and after continuous image formation (endurance sheet supply) was effected on 10,000 sheets of Office Planner A4 size paper, the number of broken hairs of the brush portion 9*b* from the brush supporting portion 9*a* was counted.

Also, again in the embodiment, the brush portion 9*b* of the charge eliminating brush member 9 was one in which a bundle of six amorphous fibers each of 20 $\mu$m was disposed at a lengthwise width of 300 mm and a pitch of 2.4 mm.

As is apparent from the result of the experiment shown in FIG. 5, when $(a-b)/b \leqq 1.0$, the break of the brush portion 9*b* becomes null. This is because as the value of (a−b)/b becomes smaller, the brush portion 9*b* tends to flex gently. Conversely, when the value of (a−b)/b is great, the brush portion 9*b* flexes suddenly and therefore stress is applied to the brush supporting portion 9*a* and thus, the brush portion is liable to be broken or come off.

It will be seen from the result of the experiment that the condition that $(a-b)/b \leqq 1.0$ is a condition under which it is difficult for the brush portion 9*b* to be broken. That is, during the condition of $(a-b) \leqq b$, the brush portion 9*b* is difficult to break.

Description will now be made of the relation between the length "a" of the entire brush portion 9*b* and the length "c" from the boundary portion 9*c* of the charge eliminating brush member 9 to the top portion 10*b* of the transport guide portion 10*a* which is contacted by the transfer material P, and the break of the brush portion 9*b*.

Figure 6:
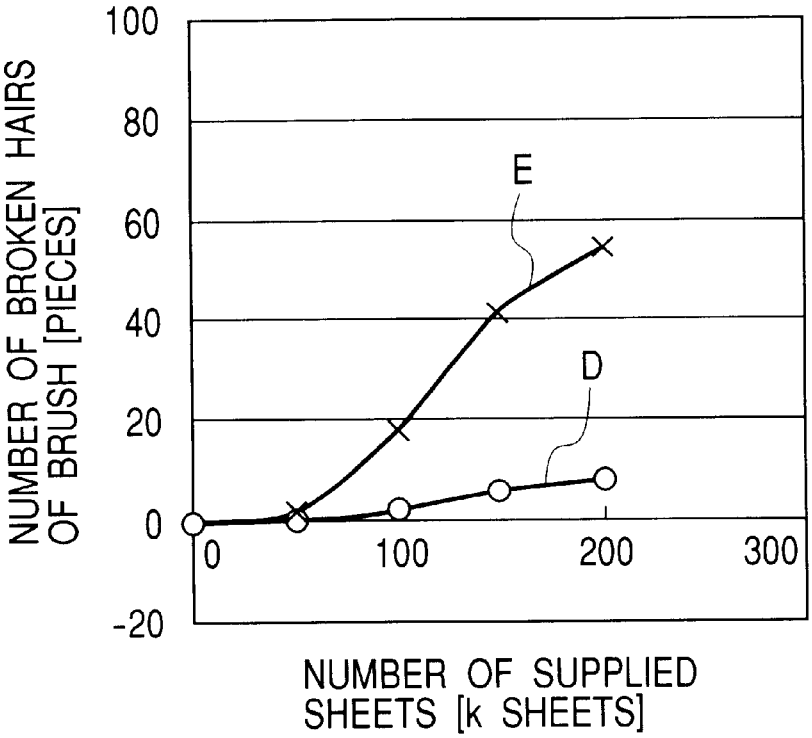
FIG. 6 is a view showing the result of an experiment, which examined the number of broken hairs of the brush portion when the sheet supply endurance test of the halftone image was done.
Figure 7:
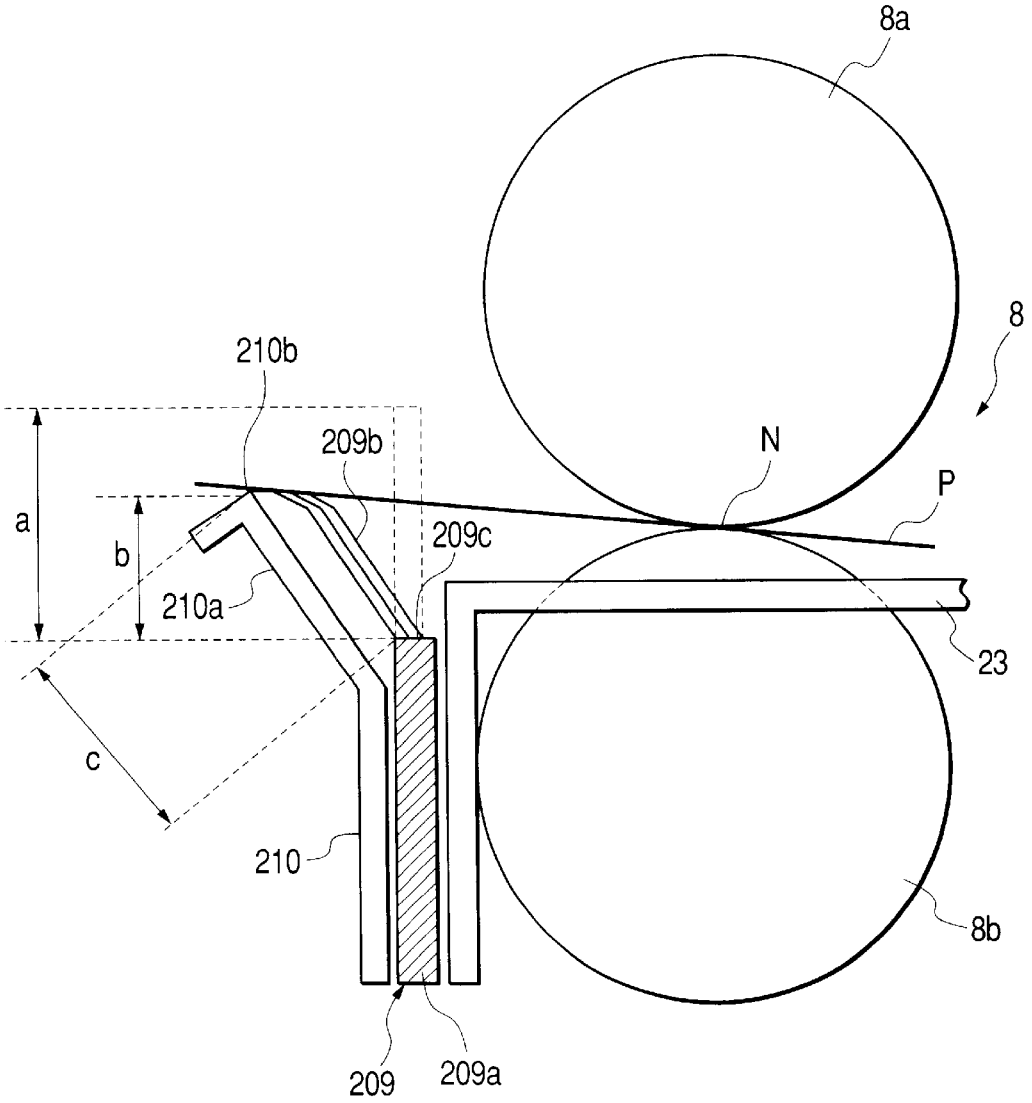
FIG. 7 is a view showing the transport regulating member and charge eliminating brush member of an image forming apparatus in a comparative example of Embodiment 1.

FIG. 6 shows the result of an experiment, which examined the numbers of broken hairs of the brush portion 9*b* by Experimental Example 1 (embodiment of the present invention: D in FIG. 6) and Experimental Example 2 (comparative example: E in FIG. 6) when halftone images were outputted (sheet supply endurance test). In Experimental Example 1, a=5.0 mm and c=5.8 mm, and "a" and "c" are in the relation that a<c. In Experimental Example 2, a=5.0 mm and C=4.5 mm, and "a" and "c" are in the relation that a>c. FIG. 7 shows the apparatus of Experimental Example 2, and the reference numeral 209 designates a charge eliminating brush member, the reference character 209*a* denotes a brush supporting portion, the reference character 209*b* designates a brush portion, the reference character 209*c* denotes a boundary portion, the reference numeral 210 designates a transport regulating member, the reference character 210*a* denotes a transport guide portion, and the reference character 210*b* designates a top portion.

Again in the experiment, use was made of the image forming apparatus shown in FIG. 1 wherein the transport speed of the transfer material (paper) P is 250 mm/sec. and A4 size paper oriented in a lateral direction is supplied at a speed of 50 ppm, and after continuous image formation (endurance sheet supply) was effected on 10,000 sheets of Office Planner A4 size paper, the number of broken hairs of the brush portion 9*b* from the brush supporting portion 9*a* was counted. Also, again in the experiment, the brush portion 9*b* of the charge eliminating brush member 9 was one in which a bundle of six amorphous fibers each of 20 $\mu$m was disposed at a lengthwise width of 300 mm and a pitch of 2.4 mm.

As is apparent from the result of the experiment shown in FIG. 6, in Experimental Example 1, there is little or no break of the brush portion 9*b*, while in Experimental Example 2, much break of the brush portion occurs. It will be seen from the result of the experiment that the condition that a<c is a condition under which it is difficult for the brush portion to be broken.

As described above, in the present embodiment, there are installed the brush portion 9*b* of the charge eliminating brush member 9 and the transport guide portion 10*a* of the transport regulating member 10 formed so as to satisfy the conditions that $a-b \geqq 0.5$ (mm), $a-b \leqq b$ and a<c.

When continuous image formation (sheet supply endurance test) was effected by the image forming apparatus of FIG. 1 in which the brush portion 9*b* of the charge eliminating brush member 9 and the transport guide portion 10*a* of the transport regulating member 10 formed so as to satisfy the above-mentioned conditions are installed downstream of the registration nip portion N in the transport direction of the transfer material, the break of the brush portion 9*b* scarcely occurred and the charges of the transfer material P being transported were eliminated well and even in the case of halftone images, images of high quality could be obtained.

As described above, in the present embodiment, even in continuous image formation (sheet supply endurance test), the break of the brush portion 9*b* of the charge eliminating brush member 9 scarcely occurs and the charges of the transporting transfer material P are eliminated well and even in the case of halftone images, images of high quality can be obtained.

Figure 8:
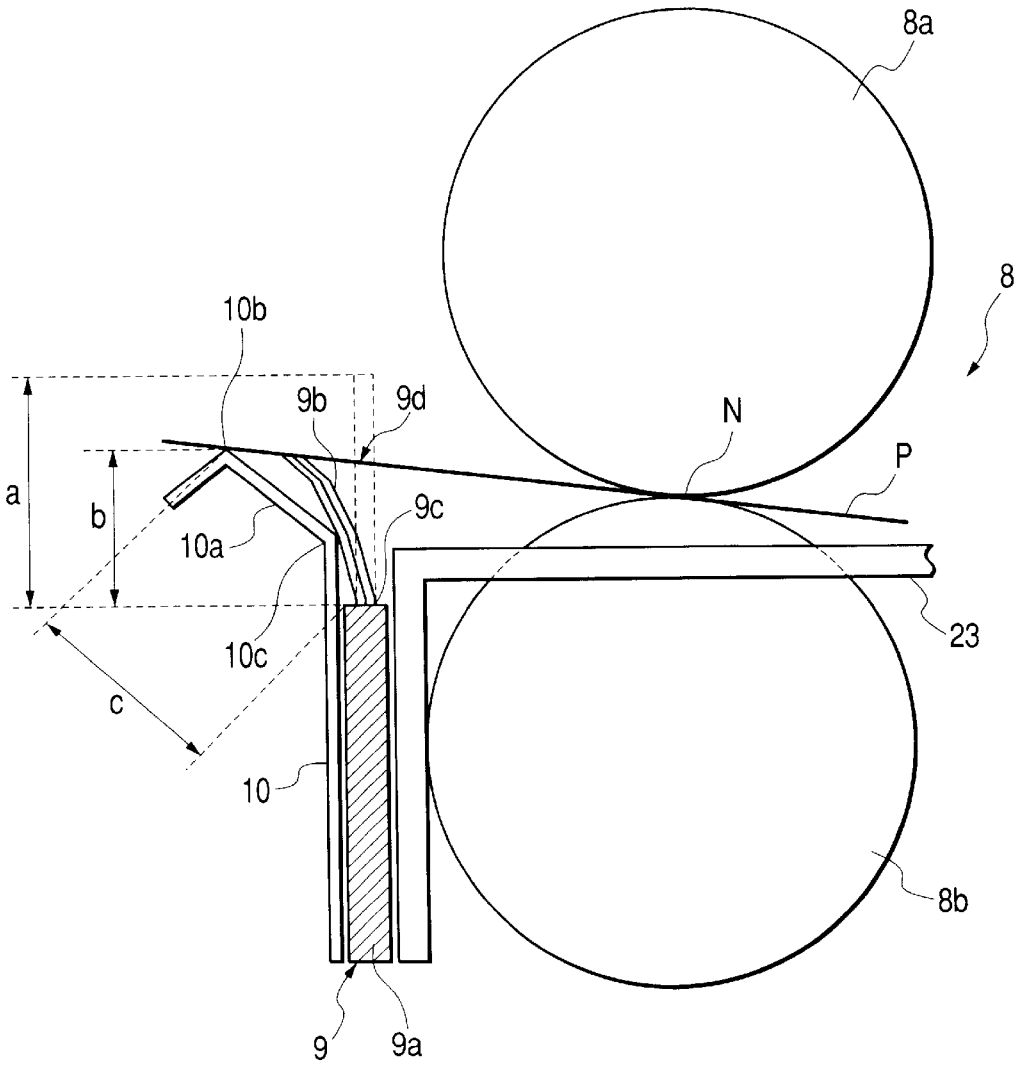
FIG. 8 is a view showing the transport regulating member and charge eliminating brush member of an image forming apparatus according to Embodiment 2.

FIG. 8 is a schematic view showing the transport guide portion 10*a* of the transport regulating member 10 of an image forming apparatus according to Embodiment 2 of the present invention. In the other points, the construction and image forming operation of the present embodiment are similar to those of Embodiment 1 and need not be described.

As shown in FIG. 8, a bent portion 10*c* provided in the upper portion of the transport regulating member 10 in the present embodiment is provided up to a location extending upwardly from the boundary portion 9*c* of the charge eliminating brush member 9, and from this position (the upper portion 10*c* of the transport regulating member 10), a transport guide portion 10*a* is integrally provided while being inclined in the transport direction of the transfer material P. That is, the bent portion 10*c* protrudes from the boundary portion 9*c* in a direction from the supporting portion toward the charge eliminating portion of the charge eliminating member. The transport regulating member 10 having the transport guide portion 10*a* of such a construction is provided downstream of the brush portion 9*b* of the charge eliminating brush member 9, whereby when the brush portion 9*b* abuts against the transfer material P being transported, the intermediate portion of the brush portion 9*b* abuts against the upper portion 10*c* of the transport regulating member 10, whereby the entire brush portion 9*b* is gently flexed and the stress in the brush supporting portion 9*a* of the brush portion 9*b* is reduced.

Again in the present embodiment shown in FIG. 8, there are installed the brush portion 9*b* of the charge eliminating brush member 9 and the transport guide portion 10*a* of the transport regulating member 10 formed so as to satisfy the conditions that $a-b \geqq 0.5$ (mm), $a-b \leqq b$ and $a<c$, as described in Embodiment 1. Specifically, the length "a" from the boundary portion 9*c* to the distal end of the brush portion 9*b* of the charge eliminating brush member 9 when not contacted by the transfer material P is 5.0 mm, the length "b" from the brush supporting portion 9*c* of the charge eliminating brush member 9 to the transporting path 9*d* of the transfer material P is 3.0 mm, and the length "c" from the boundary portion 9*c* of the charge eliminating brush member 9 to the top portion 10*b* of the transport guide portion 10*a* which is contacted by the transfer material P is 5.8 mm.

Figure 9:
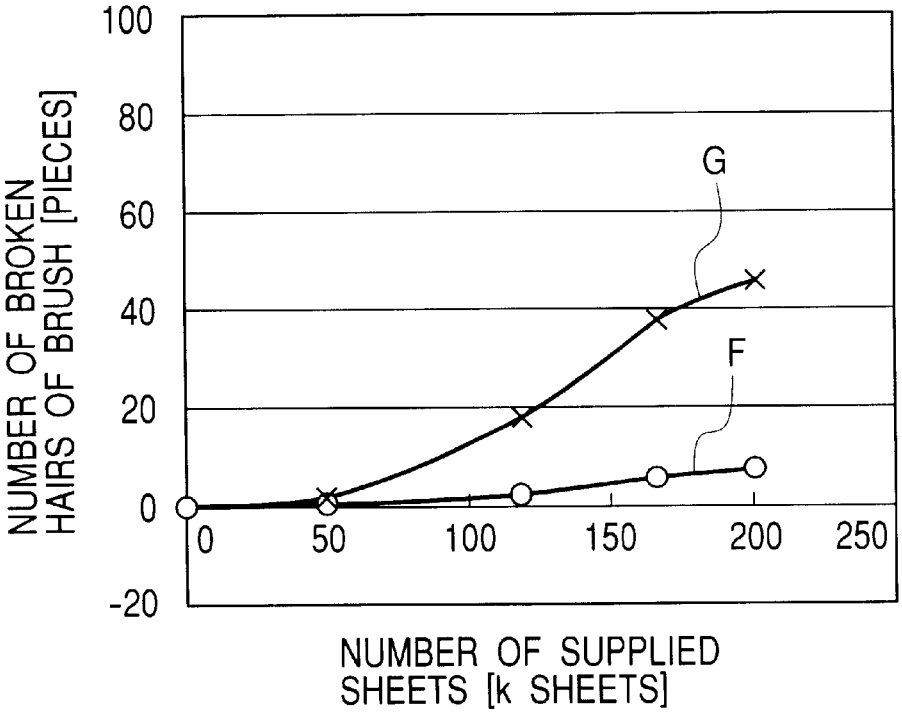
FIG. 9 is a view showing the result of an experiment, which examined the number of broken hairs of a brush portion when the sheet supply endurance test of halftone images was done.

FIG. 9 shows the result of an experiment, which examined the numbers of broken hairs of the brush portion by the present embodiment (F in FIG. 9) and a comparative example (G in FIG. 9) when halftone images were outputted (sheet supply endurance test). In the comparative example, a=5.0 mm, b=3.0 mm, and c=4.5 mm.

Again in the experiment, as in Embodiment 1, use was made of the image forming apparatus shown in FIG. 1 wherein the transport speed of the transfer material (paper) P is 250 mm/sec. and A4 size paper oriented in a lateral direction is supplied at a speed of 50 ppm, and after continuous image formation (endurance sheet supply) was effected on 10,000 sheets of Office Planner A4 size paper, the number of broken hairs of the brush portion 9*b* from the brush supporting portion 9*a* was counted. Also, again in the experiment, the brush portion 9*b* of the charge eliminating brush member 9 was one in which a bundle of six amorphous fibers each of 20 $\mu$m was disposed at a lengthwise width of 300 mm and a pitch of 2.4 mm.

Also, the paper as the transfer material P used in the experiment was Office Planner (Canon Sales Co., Inc. brand) A4 size basis weight 64 g. Also, in order to make the paper easily charged, use was made of paper left under a low-temperature and low-humidity environment of temperature 15° C. and humidity 10% RH for 24 hours and having a moisture content of 4.3(%). The moisture content of the paper before left under the above-mentioned environment was 5.8(%). The moisture content of the paper was measured by the use of MOISTREX MX5000E produced by Infrared Engineering Co., Inc.

As the halftone image in this evaluation, use was made of a pattern of 600 dpi in which a lateral line corresponding to two dots was written in the main scanning direction, and thereafter a space corresponding to three dots was provided and this was repeated.

When the occurrence of streaks on halftone images by the number of broken hairs of the brush portion by the above-described experiment when the halftone images were outputted (sheet supply endurance test) was evaluated, in a case where use was made of the transport regulating member 10 having the transport guide portion 10*a* in the present embodiment, there was no density difference between the halftone images even in sheet supply endurance test and the halftone images were at a good level and the charge eliminating property also was good. In the case of the comparative example, the halftone images were at a bad level whereat by sheet supply endurance test, streaks were clearly seen on the halftone images, and the charge eliminating property also was at a bad level.

As described above, again in the present embodiment, even in continuous image formation (sheet supply endurance test), the break of the brush portion 9*b* of the charge eliminating brush member 9 scarcely occurs and the charges of the transfer material P being transported are eliminated well and even in the case of halftone images, images of good quality can be obtained.

Embodiment 3 of the present invention will now be described.

The embodiment is similar in construction to the image forming apparatus shown in FIGS. 1 and 2, and the different portions thereof will hereinafter be described.

Figure 10:
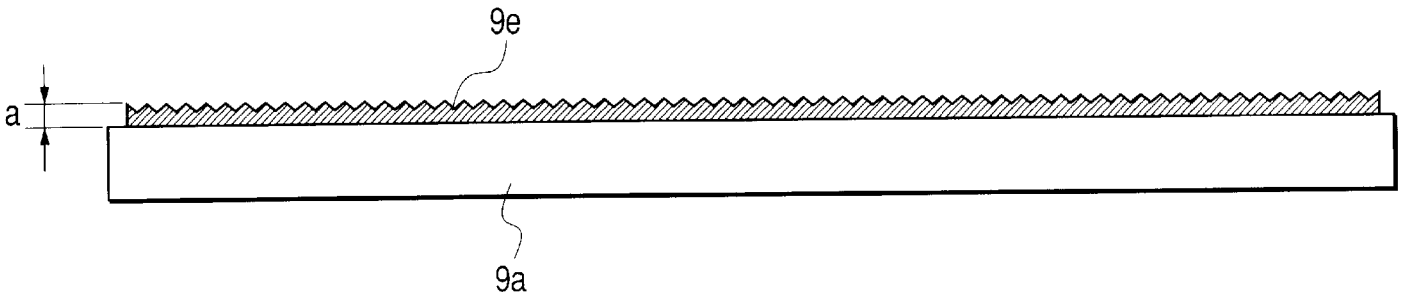
FIG. 10 is a view showing the charge eliminating brush member of an image forming apparatus according to Embodiment 3.

The present embodiment is an example of an image forming apparatus using as the transfer material label paper with glue attached thereto or special paper such as a punched slip, and as shown in FIG. 10, as the supporting portion 9*a* of the charge eliminating brush member, use is made of one supporting an electrically conductive sheet portion 9*e*. The sheet portion 9*e* is of a needle shape having a lengthwise width of 300 mm and a pitch of 2.4 mm, and is formed of a material having carbon mixed with polyester. In the other points, the construction and image forming operation of the present embodiment are similar to those of Embodiment 1 and need not be described.

Also, again in the present embodiment, as in Embodiment 1, the length "a" from the end portion (boundary portion) of the supporting portion 9*a* when not contacted by the transfer material P to the distal end of the sheet portion 9*e* is 5.0 mm, the length "b" from the end portion (boundary portion) of the supporting portion 9*a* to the transporting path of the transfer material P is 3.0 mm, and the length "c" from the end portion (boundary portion) of the supporting portion 9*a* to the top portion 10*b* of the transport guide portion 10*a* which is contacted by the transfer material P is 5.8 mm, and the aforementioned conditions that $a-b \geqq 0.5$ (mm), $a-b \leqq b$, and $a<c$ which are the features of the present invention are satisfied.

Figure 11:
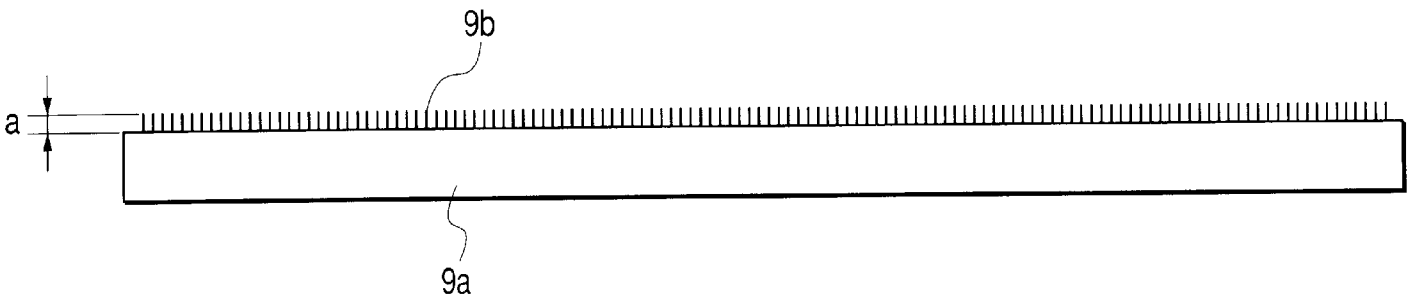
FIG. 11 is a view showing the charge eliminating brush member of an image forming apparatus in a reference example of Embodiment 3.

FIG. 11 shows the charge eliminating member of a reference example to the embodiment which is of a construction in which a brush portion 9*b* is supported on a supporting portion 9*a*, and again in the reference example, a=5.0 mm, b=3.0 mm, and c=5.8 mm.

FIG. 12 shows the result of an experiment, which examined the occurrence of streaks on halftone images by the present embodiment (Embodiment 3) and the reference example when the halftone images were outputted (sheet supply endurance test). In the sheet supply endurance test, label paper with glue Avery 5160 LTR size (produced by Avery Co., Ltd., USA) was used as the transfer material.

In the result of the experiment shown in FIG. 12, the mark ○ indicates that there is no density difference between the halftone images and the halftone images are at a good level and the charge eliminating property also is good. The mark Δ indicates that by the sheet supply endurance test, there is some density difference along the sheet supply longitudinal direction of the halftone images and it slightly appeared as a streak, but is at an allowable level, and the charge eliminating property also is at an allowable level. The mark X indicates that by the sheet supply endurance test, the halftone images are at a bad level whereat streaks are clearly seen on the halftone images, and the charge eliminating property also is at a bad level.

If the transfer material is plain paper, there is no problem in use even in the reference example, but if the transfer material is label paper with glue attached thereto, as is apparent from the result of the experiment shown in FIG. 12, in the reference example, by the sheet supply endurance test, the halftone images are at a bad level whereat streaks are clearly seen on the halftone images. This is because the brush portion 9*b* abuts against the gluey portion of the label paper and is strongly pulled, and by the sheet supply endurance test, the break of the brush portion 9*b* is increased and the charge eliminating property is reduced.

On the other hand, according to the present embodiment, streaks occurring on the halftone images by the sheet supply endurance test were at an allowable level. This is because in the present embodiment, an electrically conductive sheet (sheet portion 9*e*) is used as the charge eliminating member, whereby a force applied to the root of the surface of the supporting portion 9*a* of the sheet (sheet portion 9*e*) is dispersed in the lengthwise direction thereof and therefore, the break of the sheet (sheet portion 9*e*) is prevented, whereby good charge eliminating performance can be kept.

Also, in the reference example, the halftone images at the initial stage free of the break of the brush are at a good level free of the occurrence of streaks, whereas in the present embodiment (Embodiment 3), the halftone images are at an allowable level whereat streaks occur slightly, and this is because the brush (brush portion 9*e*) is more excellent in charge eliminating performance.

However, the present embodiment (Embodiment 3) is an image forming apparatus exclusively for special paper such as label paper or slips and therefore, it is rare in practical use to print halftone images. Even if halftone images are printed, there will be no problem because the halftone images are at an allowable level through endurance test.

When in such an image forming apparatus using as the transfer material special paper such as label paper with glue attached thereto or slips, the electrically conductive sheet portion 9*e* is used as the charge eliminating member, the break of the sheet portion 9*e* does not occur even in continuous image formation (sheet supply endurance test) and the charges of the transfer material (special paper) being transported are eliminated well and even in the case of halftone images, images of good quality can be obtained.

Figure 13:
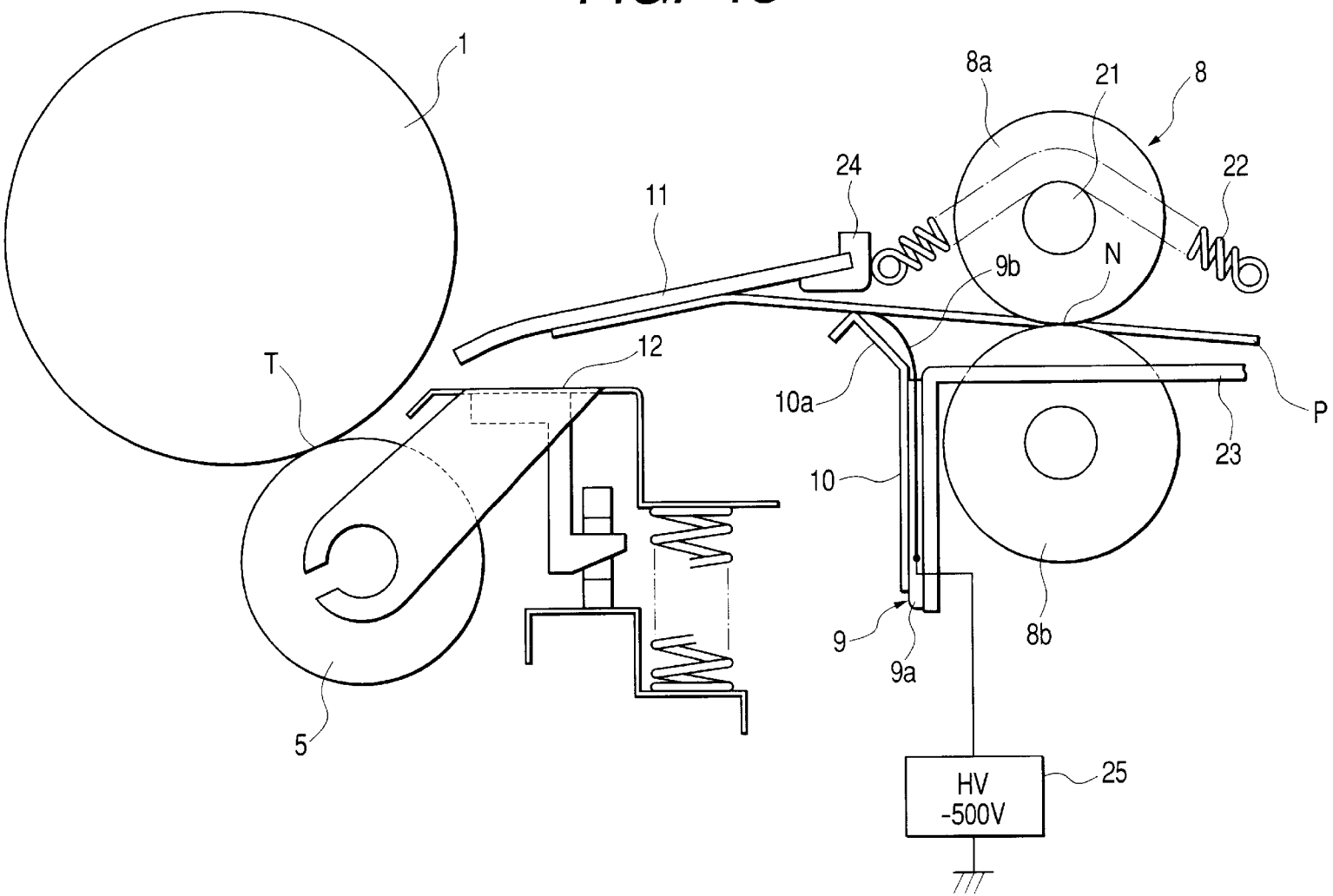
FIG. 13 is a view showing the surroundings of the transport regulating member and charge eliminating brush member of an image forming apparatus according to Embodiment 4.

FIG. 13 is a schematic view showing the vicinity of the charge eliminating brush 9 of an image forming apparatus according to Embodiment 4 of the present invention. In the embodiment, a high voltage source 25 which is voltage applying means is connected to the charge eliminating brush member 9 so as to apply a high voltage to the brush portion 9*b*. In the other points, the construction and image forming operation of the present embodiment are similar to those of Embodiment 1 or 2 (FIG. 8 of Embodiment 2) and need not be described. In the present embodiment, a voltage of −500 V is applied from the high voltage source 25 to the brush portion 9*b*. Also, in the present embodiment, a lower registration guide 23 to which the charge eliminating brush member 9 is secured and the transport regulating member 10 are formed of an insulative material.

Figure 14:
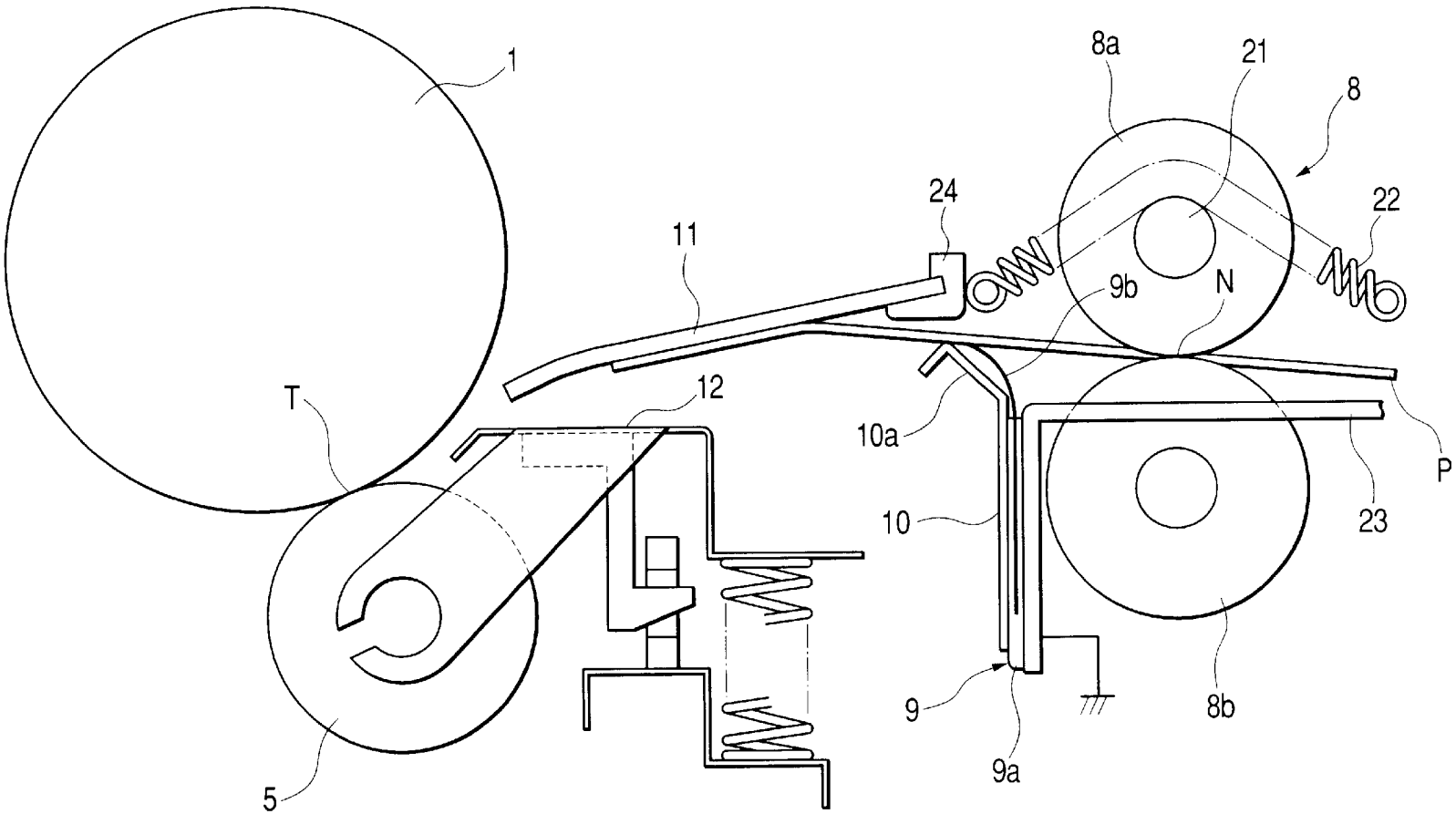
FIG. 14 is a view showing the surroundings of the transport regulating member and charge eliminating brush member of an image forming apparatus in a reference example of Embodiment 4.
Figure 16:
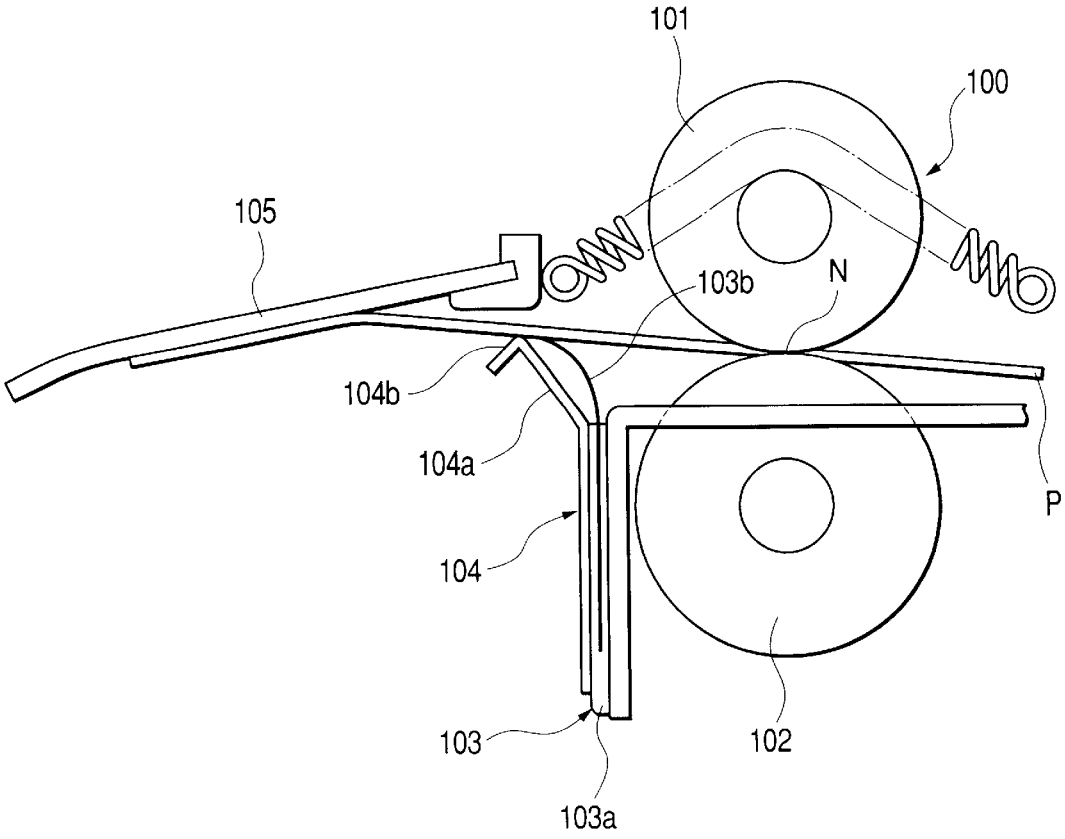
FIG. 16 is a view showing the transport regulating member and charge eliminating brush member of an image forming apparatus in the background art of the present invention.

An image forming apparatus as a reference example to the present embodiment, as shown in FIG. 14, has the charge eliminating brush member 9 earthed through the electrically conductive lower registration guide 23. In the other points, the construction of the reference example is similar to that of the present embodiment.

FIG. 15 shows the result of an experiment, which examined the occurrence of streaks on halftone images by the present embodiment (Embodiment 4) and the reference example when the halftone images were outputted (sheet supply endurance test).

Again in the experiment, as in Embodiment 1, use was made of the image forming apparatus shown in FIG. 1 wherein the transport speed of the transfer material (paper) P is 250 mm/sec. and A4 size paper oriented in a lateral direction is supplied at a speed of 50 ppm, and continuous image formation (endurance sheet supply) was effected on 10,000 sheets of A4 size paper (Office Planner and SANYI COPY PAPER hereinafter described). As SANYI COPY PAPER, use was made of paper immediately after a paper pack was opened (just opened paper) and paper left under a low-temperature and low-humidity environment of temperature 15° C. and humidity 10% RH for 24 hours and dried (left paper), and as Office Planner, use was made of left paper. Also, again in the experiment, as the brush portion 9*b* of the charge eliminating brush member 9, use was made of one in which a bundle of six amorphous fibers each of 20 μm was disposed at a lengthwise width of 300 mm and a pitch of 2.4 mm.

The paper as the transfer material P used in the experiment is Office Planner (Canon Sales Co., Inc. brand) A4 size basis weight 64 g and SANYI COPY PAPER (produced by BEIJING NO.1 PAPER MILL, China) A4 size basis weight 80 g. SANYI COPY PAPER which is acid-free paper is paper very high in resistance as compared with plain paper. Also, the resistance value of Office Planner is $10^{11-12}$ (Ω/□), and the resistance value of SANYI COPY PAPER is $10^{13-14}$ (Ω/□). The measurement of these resistance values was effected under an environment of temperature 23° C. and humidity 60% RH by the use a high resistivity meter HIRESTA IP produced by Mitsubishi Yuka Co., Ltd. with 100 V applied for 10 sec.

As the halftone image in the experiment, use was made of a pattern of 600 dpi in which a lateral line corresponding to two dots was written in the main scanning direction, and thereafter a space corresponding to three dots was provided and this was repeated.

In the result of the experiment shown in FIG. 15, the mark ○ indicates that there is no density difference between the halftone images and the halftone images are at a good level and the charge eliminating property also is good. The mark Δ indicated that by the sheet supply endurance test, there is some density difference along the sheet supply longitudinal direction of the halftone images and it slightly appeared as a streak but is at an allowable level and the charge eliminating property also is at an allowable level. The mark X indicates that by the sheet supply endurance test, the halftone images are at a bad level whereat streaks are clearly seen on the halftone images, and the charge eliminating property also is at a bad level.

If the transfer material is plain paper, there is no problem in use even in the reference example, but if the transfer material is paper high in resistance, as is apparent from the result of the experiment shown in FIG. 15, in the reference example, when use was made of left SANYI COPY PAPER high in resistance, there occurred a case where the charges could not be completely eliminated by the brush portion 9*b*, and streaks occurred on the halftone images.

On the other hand, according to the present embodiment (Embodiment 4), even if use was made of paper of high resistance liable to be charged (left SANYI COPY PAPER), streaks occurring on the halftone images by the sheet supply endurance test were at an allowable level.

It is considered that in some cases, the optimum value of the voltage applied from the high voltage source 25 to the brush portion 9*b* differs depending on the kind of the paper (transfer material) and the environment during image formation. That is, when paper (transfer material) of high resistance is used or under a low-humidity environment in which the paper is liable to be charged, the chargeability of the paper becomes high and therefore, a high bias of the opposite polarity to the charging polarity of the paper becomes necessary. Also, it is conceivable that if a bias higher than necessary is applied, paper will be charged by the bias and therefore, in some cases, the bias need be adjusted to a proper bias value.

As a method of adjusting the bias, there is a method of enabling a user to control the bias from the control panel (not shown) of the image forming apparatus. Besides it, there is also possible such a construction in which the image forming apparatus has means for detecting the resistance of paper (transfer material) and on the basis of the result of the detection thereby, a proper bias is automatically set.

As described above, in the present embodiment, besides the effect obtained by Embodiment 1, the charges of paper (transfer material) can be reliably eliminated even under an environment in which the paper (transfer material) being transported is liable to be charged and therefore, images of high quality can be obtained even when halftone images are to be formed under an environment in which paper (transfer material) is liable to be charged.

As described above, according to the present invention, when the length from the supporting surface (boundary portion) to the distal end of the charge eliminating portion of the charge eliminating member when the transfer material is not being transferred is defined as "a" (mm), and the length from the supporting surface of the charge eliminating portion of the charge eliminating member to the transporting plane on which the transfer material is transported is defined as "b" (mm), and the length from the supporting surface of the charge eliminating portion of the charge eliminating member to the top portion of the transport guide portion of the transport regulating member which is contacted by the transfer material being transported is defined as "c" (mm), the charge eliminating member and the transport guide portion of the transport regulating member are installed in such a manner as to satisfy the conditions that $a-b \geqq 0.5$ (mm), $a-b \leqq b$, and $a<c$, whereby even in continuous image formation (sheet supply endurance test), the break or coming-off of the charge eliminating portion scarcely occurs and the charges of the transfer material being transported are eliminated well, and even in the case of halftone images, images of high quality can be obtained.

Also, the break or coming-off of the charge eliminating portion is prevented, whereby the charge eliminating portion does not scatter to electrical contacts in the apparatus and thus, the occurrence of electrical leak can be prevented.

While the embodiments of the present invention have been described above, the present invention is not restricted to the above-described embodiments, but all modifications are possible within the technical idea of the present invention.

What is claimed is:

1. An image forming apparatus comprising:

an image bearing member;

transferring means for transferring an image formed on said image bearing member to a transfer material;

transporting means for transporting the transfer material to a nip between said image bearing member and said transferring means;

a regulating member for regulating a transport direction of the transfer material downstream of said transporting means in the transport direction of the transfer material; and a charge eliminating member for eliminating charges of the transfer material downstream of said transporting means and upstream of said regulating member in the transport direction of the transfer material, wherein said charge eliminating member has a charge eliminating portion and a supporting portion for supporting said charge eliminating portion, wherein said regulating member has a top portion most protruded in a direction from said supporting portion toward said charge eliminating portion of said charge eliminating member, and wherein when in a state in which the transfer material is not being transported, a length from a boundary portion between said charge eliminating portion and said supporting portion to a distal end of said charge eliminating portion is defined as "a" (millimeter), and a length from said boundary portion to a transport plane for the transfer material in a direction along said charge eliminating portion is defined as "b" (millimeter), and a length from said boundary portion to said top portion of said regulating member is defined as "c" (millimeter), the following conditions are satisfied:

$a-b \geqq 0.5$ (millimeter), $a-b \leqq b$, and $a<c$.

2. An image forming apparatus according to claim 1, wherein said charge eliminating portion is a brush.

3. An image forming apparatus according to claim 1, wherein said regulating member has a bent portion upstream of said top portion in the transport direction of the transfer material, and said bent portion protrudes from said boundary portion in the direction from said supporting portion toward said charge eliminating portion of said charge eliminating member.

4. An image forming apparatus according to claim 1, wherein said charge eliminating portion is a sheet having electrical conductivity.

5. An image forming apparatus according to claim 1, further comprising voltage applying means for applying a voltage to said charge eliminating portion.

* * * * *